United States Patent [19]

Powell

[11] 4,441,467

[45] Apr. 10, 1984

[54] SUPPLEMENTARY FUEL SYSTEM FOR ENHANCING LOW TEMPERATURE ENGINE OPERATION

[75] Inventor: Thomas M. Powell, Rochester, Mich.

[73] Assignee: General Motors Corporation, Detroit, Mich.

[21] Appl. No.: 401,076

[22] Filed: Jul. 23, 1982

[51] Int. Cl.[3] ..... F02N 9/00; F02M 7/00

[52] U.S. Cl. ..... 123/179 G; 123/180 R; 123/576

[58] Field of Search ..... 123/180 R, 180 AC, 179 R, 123/179 G, 576, 577, 578

[56] References Cited

U.S. PATENT DOCUMENTS

| | | | |
|---|---|---|---|
| 3,788,283 | 1/1974 | Perry | 123/180 R |
| 3,799,125 | 3/1974 | Hutchinson | 123/578 |
| 3,957,026 | 5/1976 | Winkley et al. | 123/179 G |
| 4,056,087 | 11/1977 | Boyce | 123/576 |
| 4,144,861 | 3/1979 | Yamashita et al. | 123/179 G |
| 4,205,641 | 6/1980 | Yamasaki | 123/179 G |

FOREIGN PATENT DOCUMENTS

| | | | |
|---|---|---|---|
| 2924128 | 12/1980 | Fed. Rep. of Germany | 123/180 AC |

*Primary Examiner*—E. Rollins Cross

*Attorney, Agent, or Firm*—C. K. Veenstra

[57] ABSTRACT

A supplementary fuel system adds gasoline to the induction passage of an ethanol fueled engine to start and sustain operation of the engine at low temperatures. The gasoline is added during cranking of the engine and in response to a rapid increase in induction passage pressure.

4 Claims, 2 Drawing Figures

SUPPLEMENTARY FUEL SYSTEM FOR ENHANCING LOW TEMPERATURE ENGINE OPERATION

TECHNICAL FIELD

This invention relates to a system for enhancing low temperature operation of an engine supplied with a low volatility fuel.

BACKGROUND

Engines fueled with ethanol have proven difficult to start at temperatures less than about 25° C. because at low temperatures ethanol does not produce sufficient vapor to support combustion. The current practice for starting ethanol fueled engines at low temperatures is to discharge a quantity of gasoline into the engine induction system; a fraction of the gasoline evaporates sufficiently to start the engine, and the subsequent increase in engine temperature is sufficient to run the engine on ethanol.

The system in current use requires the operator to prime the engine with a quantity of gasoline before starting the engine. To start and sustain operation of the engine, the operator must estimate the quantity of gasoline which should be added before the engine is started. If the operator does not add sufficient gasoline, the engine may start but subsequently stall as the engine throttle is opened. If the operator adds excess gasoline, the engine may operate satisfactorily, but the excess gasoline will be wasted.

SUMMARY OF THE INVENTION

This invention provides an improved system for starting and sustaining operation at low temperatures of an engine fueled with ethanol or other low volatility fuels.

In a system employing this invention, an electric pump automatically delivers gasoline to the engine while the starter is cranking the engine, and thus only the gasoline required for starting is delivered to and consumed by the engine during starting.

As noted above, a cold engine may run satisfactorily on ethanol but may tend to stall as the engine throttle is opened if the low volatility ethanol is unable to provide sufficient vapor to satisfy the increased requirement for fuel. In a system according to this invention, however, when the engine is cold the electric pump automatically delivers gasoline to the engine in response to the increase in engine induction passage pressure which occurs as the throttle is opened. The additional gasoline supplements the increased ethanol delivery which occurs as the throttle is opened, and sufficient fuel vapor is thereby provided to enable acceleration of the engine.

The details as well as other features and advantages of the preferred embodiment of this invention are set forth in the remainder of the specification and are shown in the accompanying drawing.

THE PRIOR ART SYSTEM

Figure 1:
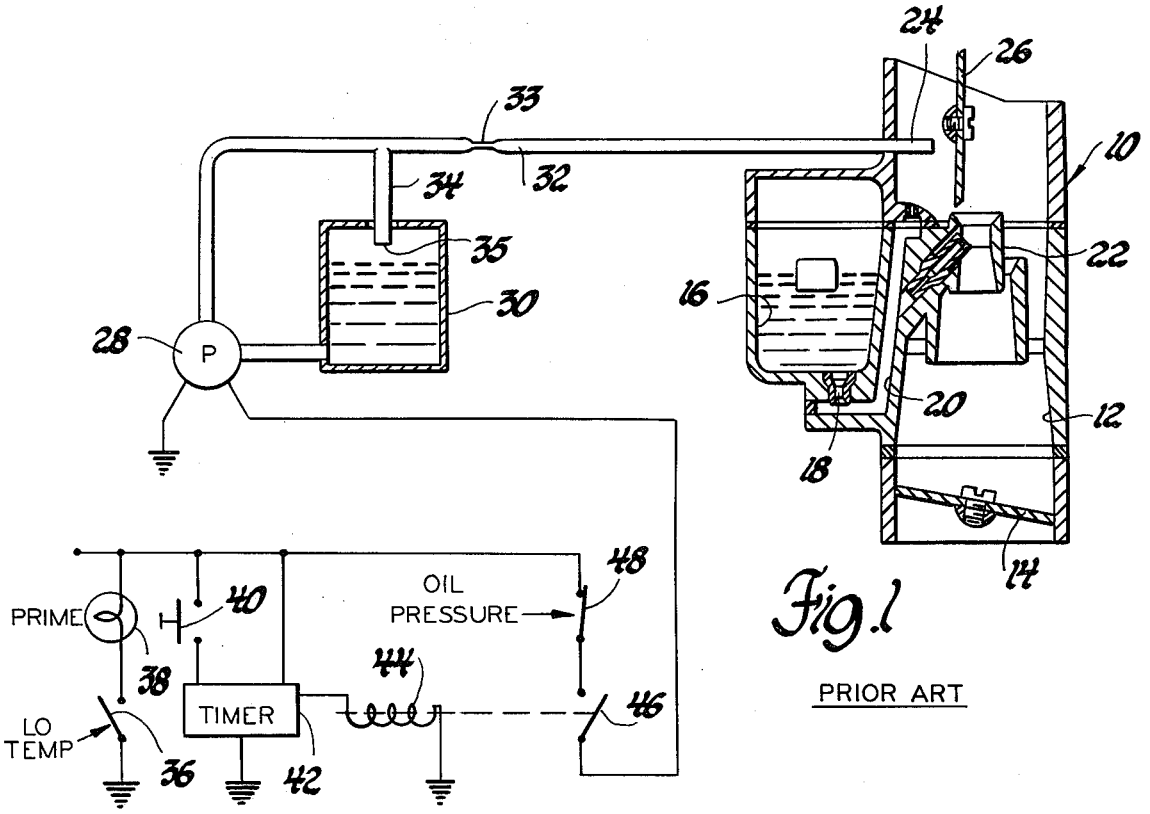
Fig. 1 PRIOR ART
FIG. 1 is a schematic view of the prior art system used for low temperature starting of an ethanol fueled engine.

Referring to FIG. 1, a carburetor 10 for an ethanol fueled engine includes an induction passage 12 for air flow to the engine and a throttle 14 to control air flow through induction passage 12. Carburetor 10 also includes a fuel bowl 16 containing liquid ethanol which is discharged in a conventional manner through a metering orifice 18 and a fuel passage 20 leading to a venturi cluster 22 in induction passage 12. There the ethanol is mixed with the air flow to provide an air-fuel mixture for combustion in the engine.

A gasoline delivery tube 24 projects into induction passage 12 below the choke 26. An electric pump 28 draws gasoline from a tank 30 and delivers the gasoline through a line 32 to tube 24 and into induction passage 12. An orifice 33 in line 32 limits flow to tube 24 to about 4.9 cc per second, and excess gasoline is returned to tank 30 through a drain 34 having a discharge end 35 above the gasoline level in tank 30.

In operation, a switch 36 closes when the engine coolant temperature is below about 25° C. to illuminate a lamp 38 suggesting that the operator prime the engine. The operator closes a manual switch 40 to energize a timer 42 which in turn energizes a relay 44 for a period of 4–5 seconds. Relay 44 closes a switch 46 to operate pump 28 for the 4–5 second period and then opens switch 46 to stop pump 28. The operator may close switch 40 to pump gasoline into induction passage 12 as many times as desired before starting the engine. When the engine starts, the increase in oil pressure opens a switch 48 to disable pump 28. After the engine is started, a portion of the gasoline remaining in line 32 will be aspirated into induction passage 12 and the remainder will drain back to tank 30; thereafter air will be aspirated through tank 30, drain 34, line 32 and tube 24, causing some gasoline to evaporate in and be lost from tank 30.

THE PREFERRED EMBODIMENT

Figure 2:
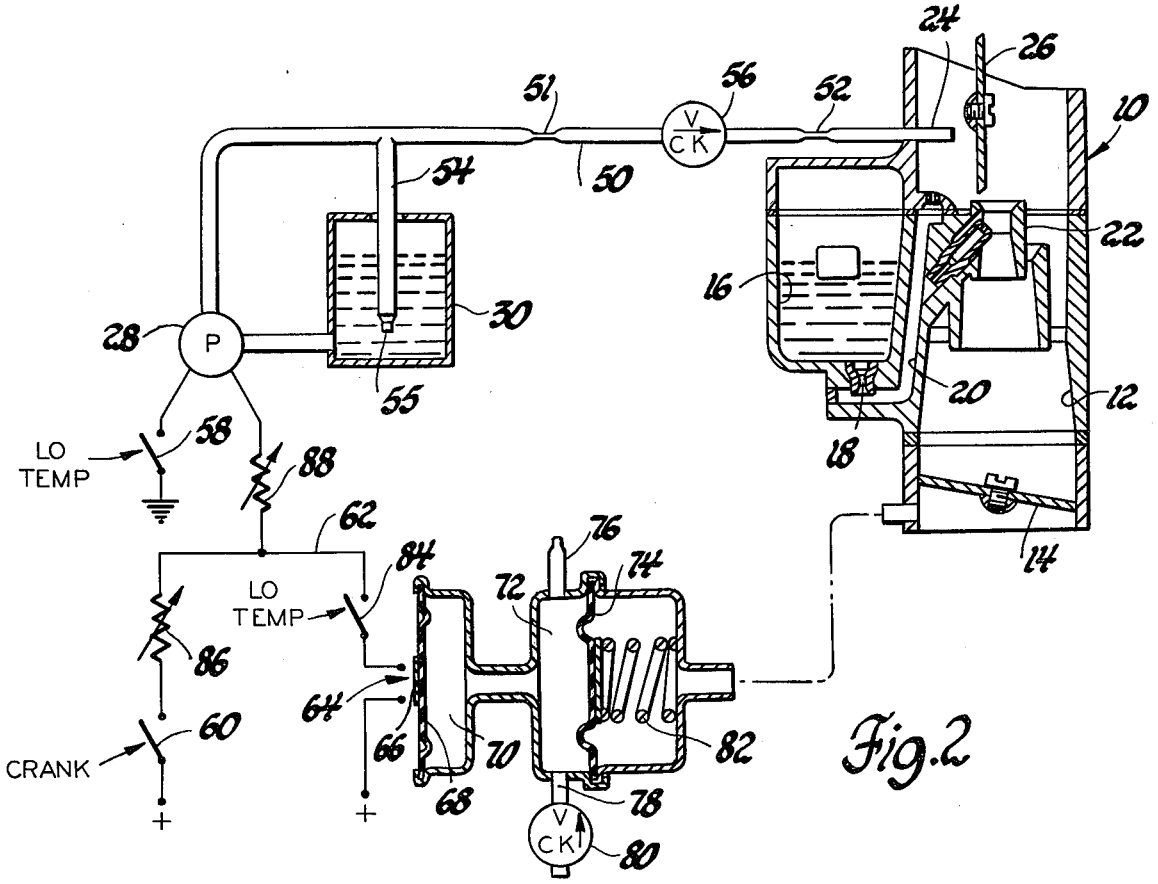
FIG. 2 is a schematic view of the preferred embodiment of this invention.

Referring now to FIG. 2, carburetor 10 is identical to carburetor 10 of FIG. 1 and has the same induction passage 12, throttle 14, liquid ethanol fuel bowl 16, metering orifice 18, fuel passage 20, venturi cluster 22, gasoline delivery tube 24 and choke 26 along with other conventional elements such as an accelerator pump. An electric pump 28 draws gasoline from a tank 30 and delivers it through a line 50 to tube 24 and into induction passage 12.

A pair of orifices 51 and 52 in line 50 limit gasoline flow to tube 24 to about 4.5 cc per second, and excess fuel is returned to tank 30 through a drain 54 having a restricted discharge end 55 near the bottom of tank 30 below the gasoline level therein. Drain 54 inhibits aspiration of air through tank 30, drain 54, line 50 and tube 24 into induction passage 12. A check valve 56 is disposed in line 50 and biased to permit pump 28 to deliver gasoline through check valve 56 but to prevent aspiration of fuel from tank 30 through drain 54, line 50 and tube 24 into induction passage 12.

In operation, a switch 58 closes at temperatures below about 25° C., and pump 28 is operated when a switch 60 is closed to crank the engine. Pump 28 is stopped when the engine starts and switch 60 is opened. With this system, the engine may be started in less than two seconds, and this system therefore starts the engine with less gasoline than the prior art system.

Pump 28 also is operated through a branch circuit 62 having a pressure operated switch 64. Switch 64 closes to operate pump 28 in response to abrupt increases in the pressure in induction passage 12 downstream of throttle 14. As shown schematically in the drawing, pressure operated switch 64 includes a contact 66 carried on a diaphragm 68 which closes a chamber 70. Chamber 70 is connected to a chamber 72 closed by a diaphragm 74. Chamber 72 has a restricted bleed 76 open to air at atmospheric pressure and an inlet 78 which may receive air at atmospheric pressure through a check valve 80. Diaphragm 74 is urged leftwardly by a spring 82 in opposition to the induction passage pressure exerted on diaphragm 74.

When the engine is started, the reduction in induction passage pressure draws diaphragm 74 rightwardly against the bias of spring 82, air flows into chamber 72 through check valve 80, and switch 64 is open. If throttle 14 is opened abruptly, the induction passage pressure increases rapidly, and spring 82 suddenly moves diaphragm 74 leftwardly. The resulting increase in pressure in chamber 72 is transmitted to chamber 70 and causes diaphragm 68 to close switch 64, thereby operating pump 28 to deliver a quantity of gasoline through tube 24 into induction passage 12. The added gasoline inhibits stalling of the engine which might otherwise occur because the low volatility ethanol delivered by carburetor 10 may be unable to provide sufficient vapor to satisfy the abruptly increased requirement for fuel.

The gasoline supplement is not required if throttle 14 is opened gradually, and the accompanying gradual increase in induction passage pressure allows spring 82 to displace diaphragm 74 gradually to the left. The resulting increase in pressure in chamber 72 is then dissipated through restricted bleed 76, and switch 64 remains open.

Should the engine tend to stall, the induction passage pressure increases quickly, and switch 64 closes to operate pump 28. Pump 28 then delivers gasoline through tube 24 into induction passage 12 to provide the fuel necessary to prevent the engine from stalling.

It is believed that while gasoline may be necessary to start the engine below a temperature of 25° C., it is not necessary to add gasoline in response to changes in induction passage pressure above a temperature in the range of 5° C.–15° C. If desired, therefore, branch circuit 62 may include a switch 84 which closes at low temperatures and opens to disable pressure responsive operation of pump 28 at a temperature above 5° C.–15° C. Irrespective of whether switch 84 is employed, addition of gasoline is not necessary to start or sustain operation of an ethanol fueled engine at temperatures above 25° C., and switch 58 opens to disable pump 28 at such temperatures.

If desired, orifice 51 may be sensitive to temperature in order to reduce gasoline delivery through line 50 and tube 24 into induction passage 12 as the temperature increases. Moreover, a temperature sensitive resistor 86 or 88 may be employed to reduce the speed of pump 28 and thereby reduce delivery of gasoline as the temperature increases.

As described herein, switches 58 and 84 respond to engine coolant temperature. It is contemplated, however, that switches 58 and 84, along with orifice 51 and resistors 86 and 88, could respond to other engine operating temperatures.

The embodiments of the invention in which an exclusive property or privilege is claimed are defined as follows:

1. A supplementary fuel system for an engine having an induction passage for air flow to the engine, a throttle in said induction passage, and a primary fuel system adapted to deliver a low volatility fuel to the engine, said supplementary fuel system comprising an electrically actuated pump for delivering gasoline to said induction passage, means for operating said pump in response to cranking of the engine at temperatures below a certain level to thereby provide fuel which vaporizes sufficiently to enable starting of the engine, and means for operating said pump in response to a rapid increase in the pressure in said induction passage downstream of said throttle at temperatures below a predetermined level to thereby provide fuel which vaporizes sufficiently to enable acceleration of the engine.

2. A supplementary fuel system for an engine having an induction passage for air flow to the engine, a throttle in said induction passage, and a primary fuel system adapted to deliver a low volatility fuel to the engine, said supplementary fuel system comprising an electrically actuated pump for delivering gasoline to said induction passage, means for operating said pump in response to cranking of the engine at temperatures below a certain level to thereby provide fuel which vaporizes sufficiently to enable starting of the engine, means for operating said pump in response to a rapid increase in the pressure in said induction passage downstream of said throttle at temperatures below a predetermined level to thereby provide fuel which vaporizes sufficiently to enable acceleration of the engine, and means for reducing the gasoline delivery to said induction passage as the engine operating temperature increases.

3. A supplementary fuel system for an engine having an induction passage for air flow to the engine, a throttle in said induction passage, and a primary fuel system adapted to deliver a low volatility fuel to the engine, said supplementary fuel system comprising an electrically actuated pump for delivering gasoline to said induction passage, means for operating said pump in response to cranking of the engine at temperatures below a certain level to thereby provide fuel which vaporizes sufficiently to enable starting of the engine, and means for operating said pump in response to a rapid increase in the pressure in said induction passage downstream of said throttle at temperatures below a predetermined level less than said certain level to thereby provide fuel which vaporizes sufficiently to enable acceleration of the engine.

4. A supplementary fuel system for an engine having an induction passage for air flow to the engine, a throttle in said induction passage, and a primary fuel system adapted to deliver a low volatility fuel to the engine, said supplementary fuel system comprising a gasoline tank, a supplemental fuel line for delivering fuel into said induction passage, an electrically actuated pump for delivering gasoline from said tank through said line, said line having a restriction limiting gasoline delivery therethrough and a check valve preventing aspiration of gasoline therethrough and a drain for discharging excess gasoline from said line into said tank below the surface of the gasoline therein, means for operating said pump in response to cranking of the engine at temperatures below a certain level to thereby provide fuel which vaporizes sufficiently to enable starting of the engine, means for operating said pump in response to a rapid increase in the pressure in said induction passage downstream of said throttle at temperatures below a predetermined level less than said certain level, to thereby provide fuel which vaporizes sufficiently to enable acceleration of the engine, and means for reducing the gasoline delivery through said line as the engine operating temperature increases.

* * * * *